US007621317B2

(12) United States Patent
Rousseau et al.

(10) Patent No.: US 7,621,317 B2
(45) Date of Patent: Nov. 24, 2009

(54) SELF-BREAKING RADIATOR SIDE PLATES

(75) Inventors: Tony P. Rousseau, Cudahy, WI (US); James S. Teece, Milwaukee, WI (US); Mark A. Kazikowski, Union Grove, WI (US)

(73) Assignee: Modine Manufacturing Company, Racine, WI (US)

( * ) Notice: Subject to any disclaimer, the term of this patent is extended or adjusted under 35 U.S.C. 154(b) by 216 days.

(21) Appl. No.: 11/432,137

(22) Filed: May 11, 2006

(65) Prior Publication Data

US 2007/0261820 A1 Nov. 15, 2007

(51) Int. Cl.
*F28D 1/04* (2006.01)

(52) U.S. Cl. ..... 165/81; 165/149

(58) Field of Classification Search ..... 165/148, 165/149, 173, 175
See application file for complete search history.

(56) References Cited

U.S. PATENT DOCUMENTS

| | | | | |
|---|---|---|---|---|
| 1,357,597 | A | 11/1920 | Springer | |
| 3,939,908 | A | 2/1976 | Chartet | |
| 4,289,169 | A | 9/1981 | Banholzer | |
| 4,576,227 | A | 3/1986 | Cadars | |
| 4,719,967 | A | 1/1988 | Scarselletta | |
| 4,721,069 | A | 1/1988 | Kreider | |
| 4,876,778 | A | 10/1989 | Hagihara et al. | |
| 5,174,366 | A | 12/1992 | Nagakura et al. | |
| 5,186,239 | A | 2/1993 | Young et al. | |
| 5,447,192 | A | 9/1995 | Woerner et al. | |
| 5,613,551 | A | 3/1997 | Rhodes | |
| 5,931,223 | A | 8/1999 | Yu et al. | |
| 5,954,123 | A | 9/1999 | Richardson | |
| 5,992,514 | A | 11/1999 | Sugimoto et al. | |
| 6,119,767 | A | 9/2000 | Kadota et al. | |
| 6,129,142 | A | 10/2000 | Beldam | |
| 6,328,098 | B1 | 12/2001 | Kodumudi et al. | |
| 6,412,547 | B1 * | 7/2002 | Siler | 165/149 |
| 6,502,305 | B2 * | 1/2003 | Martins et al. | 165/140 |
| 2007/0256819 | A1 * | 11/2007 | Alcaine et al. | 165/149 |
| 2008/0135208 | A1 | 6/2008 | Horoho | |

FOREIGN PATENT DOCUMENTS

| | | | |
|---|---|---|---|
| DE | 197 53 408 | A1 | 6/1999 |
| DE | 102005043291 | A1 * | 3/2006 |
| EP | 0 524 085 | A1 | 1/1993 |
| EP | 0 748 995 | A2 | 12/1996 |
| EP | 1 001 241 | A2 | 5/2000 |
| EP | 1 195 523 | B1 | 6/2005 |
| FR | 1 423 854 | | 5/1973 |
| FR | 2 270 543 | | 12/1975 |
| FR | 2 527 325 | | 11/1983 |
| JP | 1-131898 | | 5/1989 |
| JP | 5-157484 | | 6/1993 |

* cited by examiner

*Primary Examiner*—Teresa J Walberg
(74) *Attorney, Agent, or Firm*—Michael Best & Friedrich LLP

(57) ABSTRACT

A side plate for a heat exchanger, a heat exchanger and a method for making a heat exchanger are provided. The side plate, which may be incorporated into the heat exchanger, includes a first body piece having a first edge and a second body piece having a second edge. The first and second edges are separated by an opening except for point connections. After the heat exchanger is assembled the point connections may be sheared to permit the side plate to expand and contract as a result of positive and negative stresses.

8 Claims, 4 Drawing Sheets

SELF-BREAKING RADIATOR SIDE PLATES

FIELD OF THE INVENTION

This invention relates to heat exchangers, and more specifically, to improved side plates for heat exchangers; as well as methods of making a heat exchanger.

BACKGROUND OF THE INVENTION

Many heat exchangers in use today, as, for example, vehicular radiators, oil coolers, and charge air coolers, are based on a construction that includes two spaced, generally parallel headers which are interconnected by a plurality of spaced, parallel, flattened tubes. Located between the tubes are thin, serpentine fins. In the usual case, the side most tubes are located just inwardly of side plates on the heat exchanger and serpentine fins are located between those side most tubes and the adjacent side plate.

The side plates are typically, but not always, connected to the headers to provide structural integrity. They also play an important role during the manufacturing process, particularly when the heat exchanger is made of aluminum and components are brazed together or when the heat exchanger is made of other materials and some sort of high temperature process is involved in the assembly process.

More particularly, conventional assembly techniques involve the use of a fixture which holds a sandwiched construction of alternating tubes and serpentine fins. The outside of the sandwich, that is the outer layers which eventually become the sides of the heat exchanger core, is typically provided with side plates whose ends are typically connected mechanically to the headers. Pressure is applied against the side plates to assure good contact between the serpentine fins and the tubes during a joining process such as brazing to assure that the fins are solidly bonded to the tubes to maximize heat transfer at their points of contact. If this is not done, air gaps may be located between some of the crests of the fins and the adjacent tube which adversely affect the rate of heat transfer and durability, such as the ability to resist pressure induced fatigue and to withstand elevated pressures.

At the same time, when the heat exchanger is in use, even though the side plates may be of the same material as the tubes, because a heat exchange fluid is not flowing through the side plates but is flowing through the tubes, the tubes will typically be at a higher temperature than the side plates, at least initially during the start up of a heat exchange operation.

This in turn results in high thermal stresses in the tubes and headers. Expansion of the tubes due to relatively high temperatures tends to push the headers apart while the side plates, at a lower temperature, tend to hold them together at the sides of the core. All too frequently, this severe thermal stress in the heat exchanger assembly results in fracture or the formation of leakage openings near the tube to header joints which either requires repair or the replacement of the heat exchanger.

It has been proposed to avoid this problem, after complete assembly of the heat exchanger, by sawing through the side plates at some location intermediate the ends thereof so that thermal expansion of the tubes is accommodated by the side plates, now in multiple sections, which may move relative to one another at the saw cut. However, this solution adds an additional operation to the fabrication process and consequently is economically undesirable.

Another approach is to construct the side plate so that it breaks when it is put in tension by positive stresses caused by a differential thermal expansion, such as shown in U.S. Pat. No. 6,412,547, issued Jul. 2, 2002 and naming Nicholas R. Siler as the inventor. This approach eliminates the need for an additional operation such as saw cutting. However, in addition to the above positive stresses caused by expansion, heat exchangers may also undergo negative stresses or compression. Negative stresses may be caused by thermal expansion and contraction of the heat exchanger itself as well as the thermal expansion and contraction of external components connected to the heat exchanger which may cause the heat exchanger to compress. The above solution shown in the U.S. Pat. No. 6,412,547 patent does not provide for compression of the side plate caused by negative stresses.

SUMMARY OF THE INVENTION

In accordance with one form a side plate for use in a heat exchanger is provided. The heat exchanger includes a core extending along a longitudinal axis between a pair of spaced, generally parallel headers. The side plate includes a first body piece having a first edge and a second body piece having a second edge. The first and second edges define at least one opening separating the first and second body pieces except for four or fewer point connections between the first and second edges. Each of the point connections defined by intersecting portions of the first and second edges that form a vertex aligned with the longitudinal axis of the side plate.

In one form, a heat exchanger is provided having a core extending between a pair of spaced, generally parallel headers and a pair of elongated side plates, one at each side of the heat exchanger. The heat exchanger includes an improvement wherein each side plate includes a first body piece having a first edge and a second body piece having a second edge. The first and second edges define at least one opening separating the first and second body pieces except for four or fewer point connections between the first and second edges. Each of the side plates has a first state wherein the point connections connect the first and second edges and have a second state wherein the point connections are sheared along a longitudinal line to permit the first and second body pieces to move closer and further away from each other.

According to one form a side plate for use in a heat exchanger is provided. The heat exchanger includes a core extending along a longitudinal axis between a pair of spaced, generally parallel headers. The side plate includes a first body piece having a first edge and a second body piece having a second edge. The first and second edges define at least one opening separating the first and second body pieces except for a plurality of point connections between the first and second edges. Each of the point connections defined by intersecting portions of the first and second edges that form a vertex aligned with the longitudinal axis of the side plate.

According to one form, a heat exchanger is provided having a core extending between a pair of spaced, generally parallel headers and a pair of elongated side plates, one at each side of the heat exchanger. The heat exchanger includes an improvement wherein each side plate includes a first body piece having a first edge and a second body piece having a second edge. The first and second edges define at least one opening separating the first and second body pieces except for a plurality of point connections between the first and second edges. The side plate have a first state wherein the point connections connect the first and second edges and have a second state wherein the point connections are sheared along a longitudinal line to permit the first and second body pieces to move closer and further away from each other.

In one form, each of the point connections is defined by intersecting portions of the first and second edges that form two opposing vertices aligned with the longitudinal axis of the side plate.

According to one form, the heat exchanger further includes a third body piece including a third edge and wherein the second body piece further includes a fourth edge. The third and fourth edges define at least one opening separating the second and third body pieces except for four or fewer point connections between the third and fourth edges. Each of the point connections are defined by intersecting portions of the third and fourth edges that form a vertex aligned with the longitudinal axis of the side plate.

In accordance with one form, the first edge, second edge and the point connections define three openings.

In on form, each of the first and second body pieces includes a base and at least two legs, wherein the legs extend substantially 90 degrees from the base and at least a portion of one opening extends from the base onto one leg.

According to one form, the first edge, the second edge and one point connection define a void region on one of the legs.

In accordance with one form, at least one point connection is located on each leg and at least one point connection is located on the base.

In one form, a method for manufacturing a heat exchanger is provided. The method includes the steps of:

assembling the components of a heat exchanger core in a fixture extending between a pair of spaced headers, side plates extending between the headers wherein the side plates include a first body piece having a first edge and a second body piece having a second edge, the first and second edges defining at least one opening separating the first and second body pieces except for four or fewer point connections between the first and second edges, the assembly having a first length measured between the spaced headers, brazing the assembly together; and subjecting the brazed assembly to thermally induced stresses to allow the point connections to shear along a generally longitudinal line and the brazed assembly is permitted to expand and contract relative to the first length as the brazed assembly is subjected to positive and negative stresses.

Other objects, advantages, and features will become apparent from a complete review of the entire specification, including the appended claims and drawings.

DETAILED DESCRIPTION OF THE PREFERRED EMBODIMENTS

The present invention will be described hereinafter as a vehicular radiator, as, for example, a radiator for a large truck. However, it should be understood that the invention is applicable to radiators used in other contexts, for example, a radiator for any vehicle or for stationary application as an internal combustion engine driven generator. The invention is also useful in any of the many other types of heat exchangers that utilize side plates to provide structural support, or hold serpentine fins against parallel tubes extending between spaced headers, for example, oil coolers and charge air coolers. Accordingly, no limitation to any particular use is intended except insofar as expressed in the appended claims.

Figure 1:
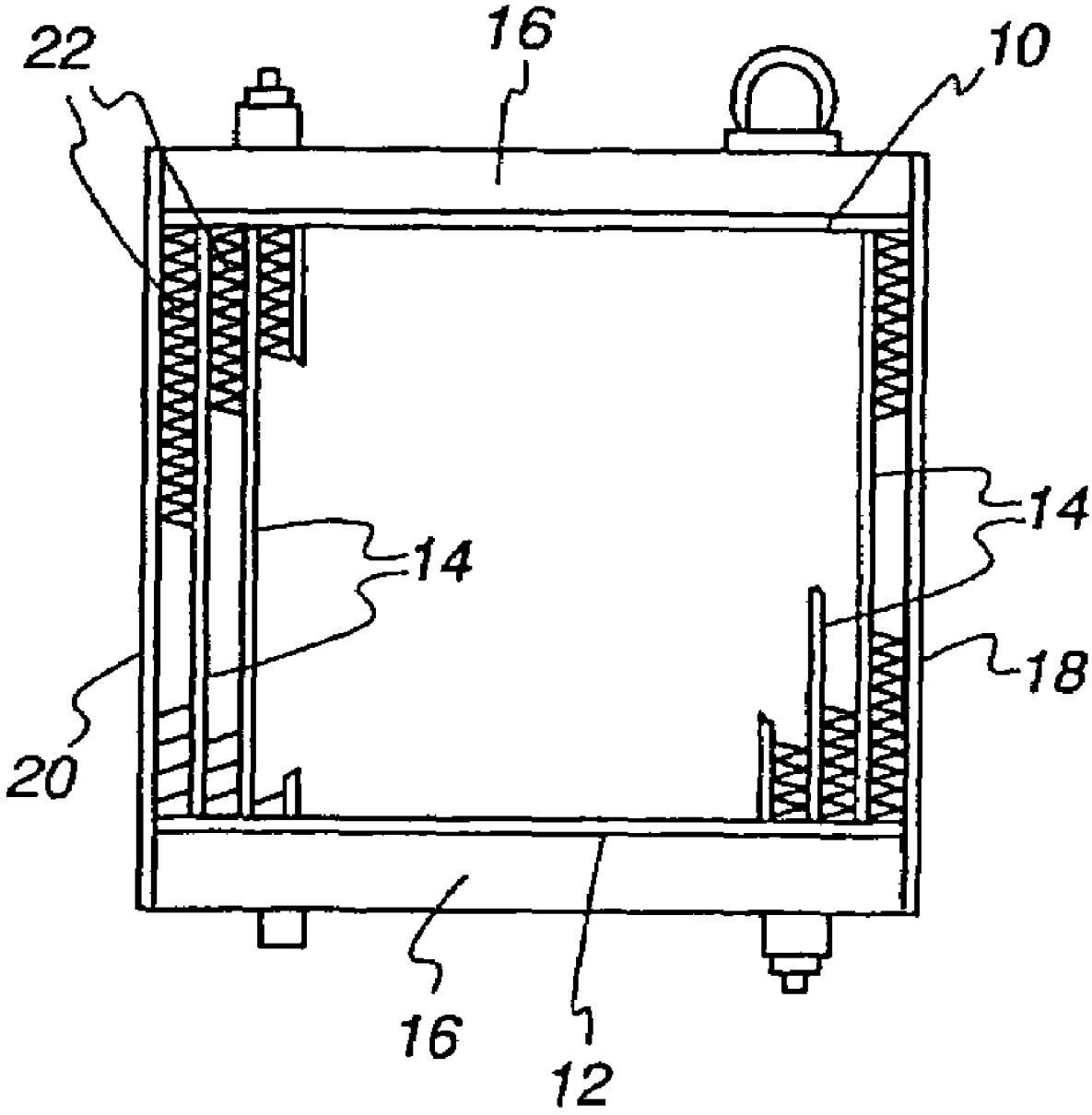
FIG. 1 is a somewhat schematic, side elevation of a heat exchanger made according to the present invention.

Referring to FIG. 1, a typical heat exchanger of the type of concern includes spaced, parallel header plates 10, 12, between which a plurality of flattened tubes 14 extend. The tubes 14 are spaced from one another and their ends are brazed or welded or soldered and extend through slots, not shown, in the header plates 10 and 12 so as to be in fluid communication with the interior of a tank 16 fitted to each of the header plates 10, 12. In this regard, it is to be noted that as used herein, the term "header" collectively refers to the header plates 10, 12, to the header plates 10, 12 with the tanks 16 secured thereon, or integral header and tank constructions known in the art as, for example, made by tubes or various laminating procedures. Side plates 18, 20 flank respective sides of the heat exchanger construction and extend between the headers 10, 12 and are typically mechanically connected thereto as well as metallurgically bonded thereto.

Between the spaced tubes 14, and between the endmost tube 14 and an adjacent one of the side plates 18, 20 are conventional serpentine fins 22. As is well known, the fins 22 maybe formed of a variety of materials. Typical examples are aluminum, copper and brass. However, other materials can be used as well depending upon the desired strength and heat exchange efficiency requirements of a particular application.

In a highly preferred embodiment of the invention, all of the just described components, with the possible exception of the tanks 16 which may be formed of plastic, are formed of aluminum or aluminum alloy and are braze clad at appropriate locations so that an entire assembly is illustrated in FIG. 1 may be placed in a brazing oven and the components all brazed together. In the usual case, prior to brazing, an appropriate fixture is employed to build up a sandwich made up of the tubes 14 alternating with the serpentine fins 22 and capped at each end by the side plates 18 and 20. The headers 10, 12 are fitted to the ends of the tubes 14 and in the usual case, the side plates 18 and 20 may be mechanically coupled to the headers 10, 12 typically by bending tabs on the side plates 18 over the corresponding ends of the headers 10, 12.

Figure 2:
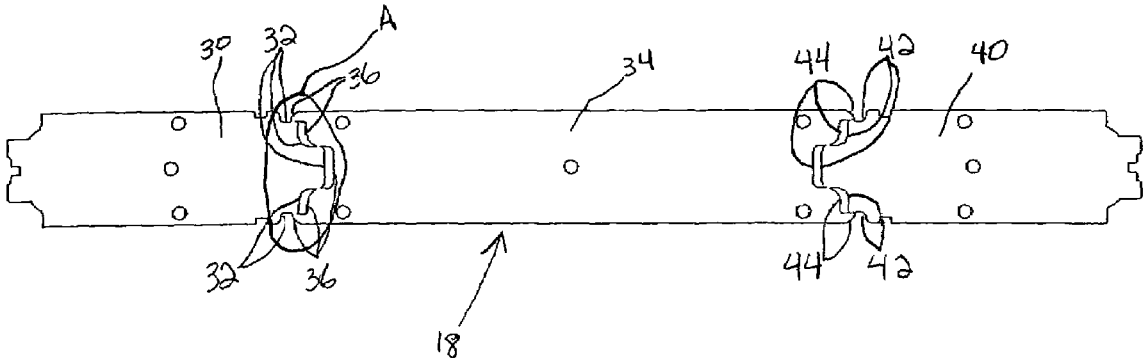
FIG. 2 is top view of a partially completed side plate.

FIG. 2 illustrates one embodiment of a side plate 18 for use with a heat exchanger. As illustrated, the side plate 18 is made from a single, unitary piece of material, preferably a strip of metal sheet material such as aluminum and includes a first body piece 30 having a first edge 32 and a second body piece 34 having a second edge 36. Additionally, in this embodiment, the side plate includes a third body piece 40 having a third edge 42 while the second body piece includes a fourth edge 44. All of the pieces 30, 34 and 40 are connected into a single, unitary body by a plurality of point connections 46 that are sized and configured to break or shear from differential thermal expansion during normal operation of the heat exchanger or during a brazing operation. While this embodiment is shown as having three body piece 30, 34 and 40, it should be understood by those skilled in the art that the side plate 18 may include merely two body pieces, as well as more than three body pieces, as desired.

Figure 3:
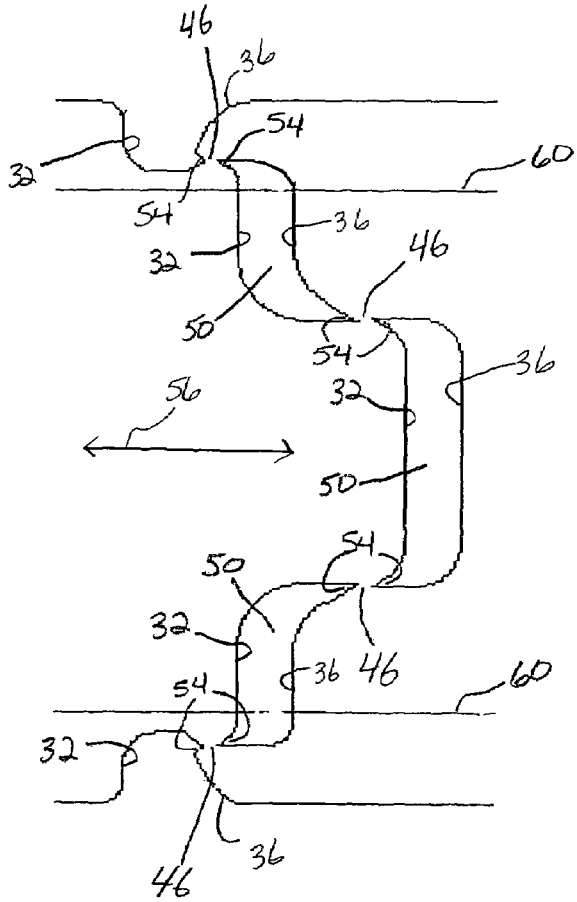
FIG. 3 is an enlarged view of portion of the side plate of FIG. 2.

Referring to FIG. 3, which is an enlarged representation of area A from FIG. 2, the edges 32 and 36 can be seen in more detail. In this embodiment, the first and second edges 32 and 36 define three openings 50 separating the first and second body pieces 30 and 34. While this embodiment is shown as having three openings 50, it should be understood by those skilled in the art that the side plate 18 may include as few as one opening or more than one opening. The first and second edges 32 and 36 are separated by four point connections 46. While this embodiment is shown as having four point connections 46, it should be understood by those skilled in the art four or fewer point connections may be used, such as two point connections. This is particularly true for planar (non-channel shaped) side plates.

Each of the point connections 46 is preferably defined by intersecting portions of the first and second edges 32 and 36 that form a vertex 54 aligned with a longitudinal axis 56 of the side plate 18. Specifically, each of the vertex 54 is generally parallel with the longitudinal axis 56. As discussed above, the embodiment shown in FIG. 2 has three body pieces. While FIG. 3 was described related to the interaction of the first and second body pieces 32 and 36, it should be understood by those skilled in the art that the interaction between the second and third body pieces 36 and 40 is substantially similar.

The embodiment illustrated in FIGS. 2-3 is in a partially completed form. While the side plate 18 may be utilized in its partially completed form, the side plate 18 may be further manipulated to add strength to the side plate 18.

Figure 4:
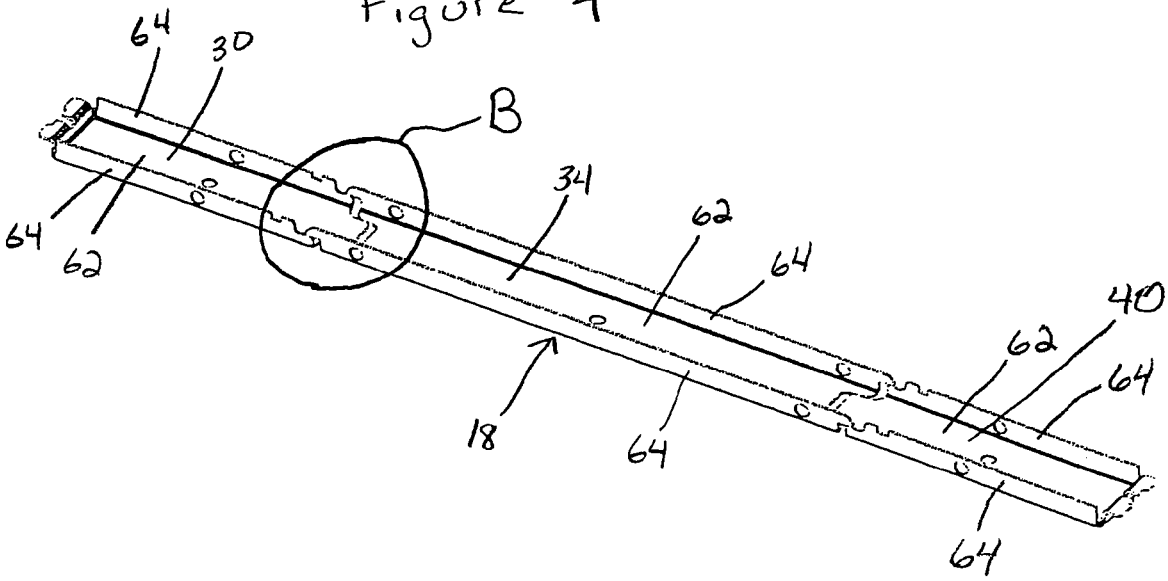
FIG. 4 is a side elevation of a completed side plate.

Specifically, lines 60 depict locations where the side plate 18 may be bent or folded to create a channel shape having a base 62 and legs 64, as shown in FIG. 4. Generally, the legs 64 may be bent approximately 90 degrees from the base 62 to further strengthen the side plate 18. Alternatively, the legs 64 may be bent at any angle and/or at opposing directions as desired.

Figure 5:
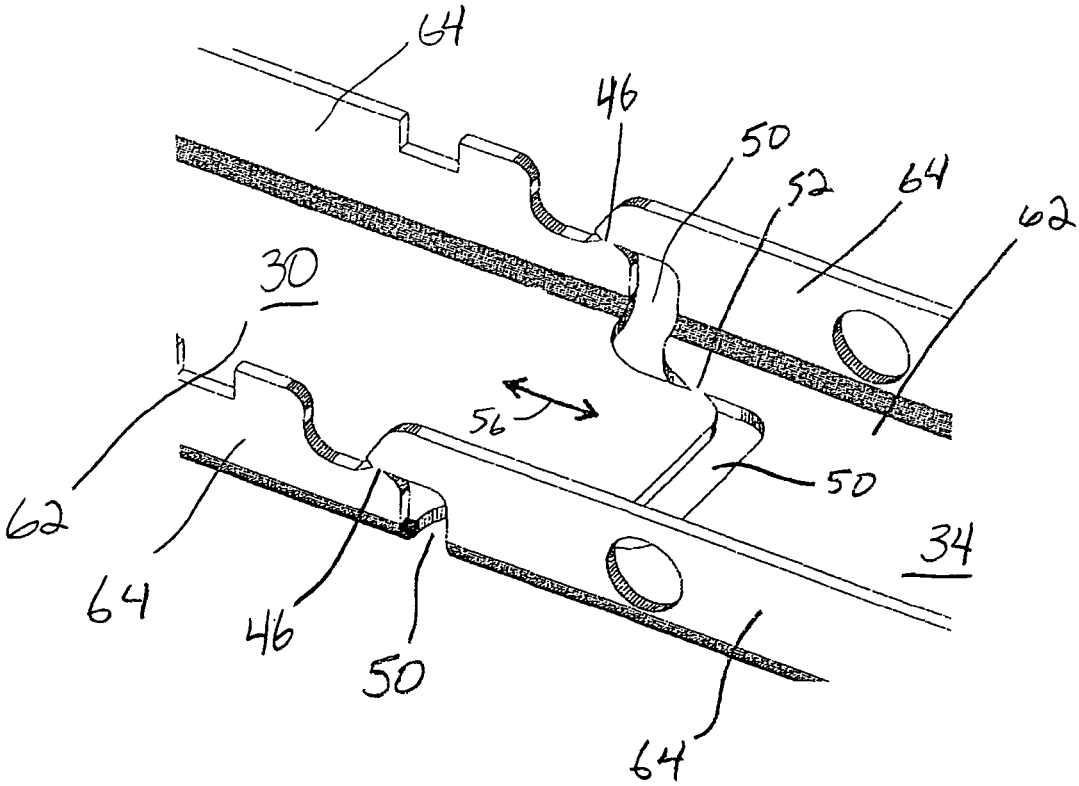
FIG. 5 is an enlarged view of a portion of the side plate of FIG. 4 in a first state.

Referring to FIG. 5, which is an enlarged view of area B taken from FIG. 4, the edges 32 and 36 of the side plate 18 as well as the legs 64 and base 62 can be seen in more detail. As can be seen in this figure, both of the legs 64 extend substantially 90 degrees in the same direction from the base 62. Furthermore, as can be seen in this figure, at least a portion of one opening 50 is located on each leg 64 and on the base 62. Similarly, at least one point connection 46 is located on each leg 64 and on the base 62. In fact, in the embodiment shown in FIGS. 4-5, there are two point connections 46 located on the base 62.

FIGS. 4-5 depict a first state wherein the point connections 46 connect the first and second edges 32 and 36. In this first state, the side plate 18 is generally rigid and does not expand or compress. While in the first state, the side plate 18 is especially suited for providing strength while assembling the heat exchanger.

Figure 6:
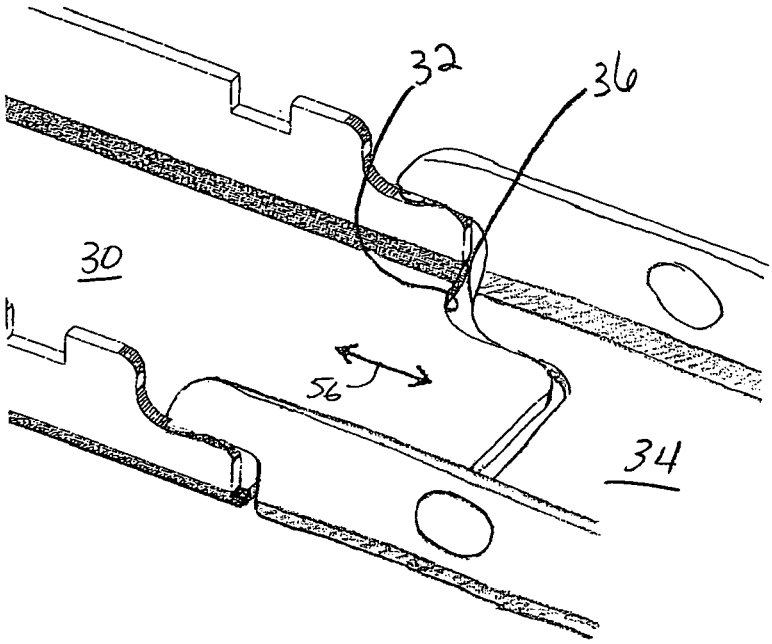
FIG. 6 is an enlarged view of a portion of the side plate of FIG. 4 in a second state.
Figure 7:
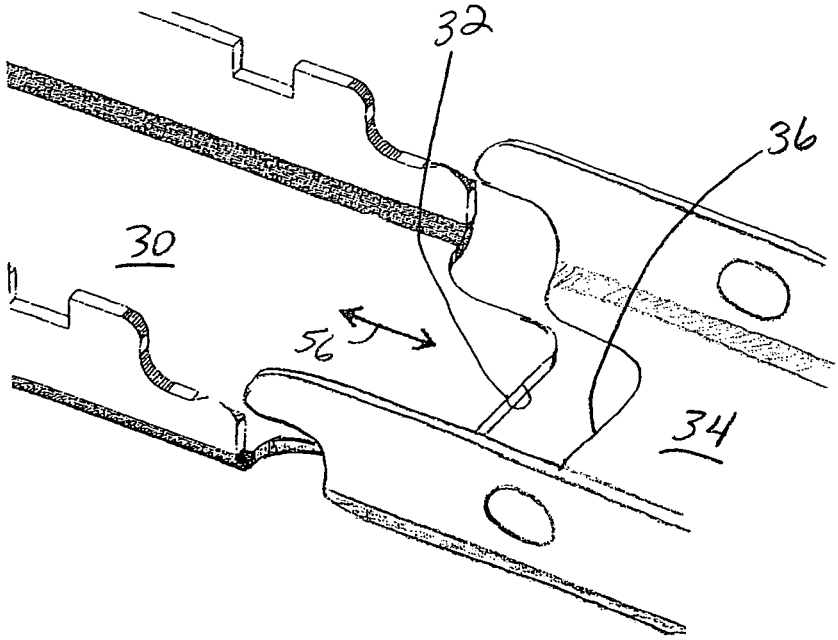
FIG. 7 is an enlarged view of a portion of the side plate of FIG. 4 in an alternative position of the second state.

FIGS. 6-7 depict a second state wherein the point connections 46 have been sheared along the longitudinal axis 56 to permit the first and second body pieces 30 and 34 to move closer, as in FIG. 6, and further away from each other, as in FIG. 7. Specifically, in this state, the point connections 46 have been sheared parallel to the longitudinal axis 56 such that the first and second body pieces 30 and 34 are free to move towards and away from one another. It should be understood that either one or both of the body pieces 30 and 34 may move as the heat exchanger is subjected to stresses from the heat exchanger's own thermal expansion and contraction as well as from external stresses. It should also be understood by those skilled in the art that additional body pieces, such as the third body piece 40 would shear similarly to that described above to have similar first and second states. Again, while the above description refers to the first and second body pieces 30 and 34, it should be understood that additional body pieces may be incorporated into the side plate which may or may not include similar structure to that described above. Additionally, while the above description makes reference to side plate 18, it should be understood that similar structure may also be located on the side plate 20.

The side plates 18,20 may be made by conventional methods such as stamping. For example, in one embodiment, metal is stamped into the configuration shown in FIG. 2. After stamping, the legs 64 are bent to form the final side plate as shown in FIG. 4.

The heat exchanger made according to the invention is fabricated by an inventive method that includes, as a first step, the step of assembling the components of the heat exchanger, namely, the headers 10, 12, the tubes 14, the side plates 18, 20 and the serpentine fins 22 in a fixture so that the headers 10,12 are spaced with the tubes 14 spaced and extending between the headers 10,12 into slots therein and side plates 18,20 extending between the headers 10,12 at the sides of the core together with serpentine fins 22 located between adjacent tubes 14 and between the side plates 18,20 and the adjacent tube at each of the sides of the core. The side plates 18,20 are typically, but not always, mechanically fixed at each end to the adjacent header.

The resulting assembly is then subjected to brazing temperatures to both braze the components together and to allow the thermal stresses involved in the brazing process to shear each side plate at the point connections as a result of thermally induced stress. Whether shearing actually occurs will depend upon the rate the assembly cools following brazing. In some cases, the shearing may not occur or may not fully occur during the brazing process, but will occur when the heat exchanger is placed in use, after a few thermal cycles of operation. In any event, the point connections 46 will shear in use well before damage to the tube to header joints or elsewhere in the heat exchanger can occur.

The invention claimed is:

1. A side plate for use in a heat exchanger, the heat exchanger including a core extending along a longitudinal axis between a pair of spaced, generally parallel headers, the side plate comprising:

a first body piece including a first edge; and a second body piece including a second edge, each of the first and second body pieces including a base and a leg extending generally normal from the base to produce a generally channel shape;

the first and second edges defining at least one opening separating the first and second body pieces except for four or fewer point connections between the first and second edges, each of the point connections defined by intersecting portions of the first and second edges such that, when each of the four or fewer point connections break, the at least one opening and the connections allow the first and second body pieces to remain in contact while sliding past one another in a direction substantially parallel to the longitudinal axis to accommodate thermal expansion and contraction of the side plate; and wherein at least one point connection is located between the bases of the first and second body pieces and at least one point connection is located between the legs of the first and second body pieces.

2. The side plate of claim 1 wherein each of the point connections is defined by intersecting portions of the first and second edges that form two opposing vertices aligned with the longitudinal axis of the side plate.

3. The side plate of claim 1 further comprising a third body piece including a third edge, wherein the second body piece further includes a fourth edge, the third and fourth edges defining at least one opening separating the second and third body pieces except for four or fewer point connections between the third and fourth edges, each of the point connections defined by intersecting portions of the third and fourth edges that form a vertex aligned with the longitudinal axis of the side plate.

4. The side plate of claim 1 wherein the first edge, second edge and the point connections define three openings.

5. The side plate of claim 1 wherein the first edge, the second edge and one point connection define a void region on one of the legs.

6. A side plate for use in a heat exchanger, the heat exchanger including a core extending along a longitudinal axis between a pair of spaced, generally parallel headers, the side plate comprising:

a first body piece including a first edge; and a second body piece including a second edge, each of the first and second body pieces including a base and a leg extending generally normal from the base to produce a generally channel shape;

the first and second edges defining at least one opening separating the first and second body pieces except for a plurality of point connections between the first and second edges, each of the point connections defined by intersecting portions of the first and second edges and the point connections being breakable such that, when the plurality of point connections break, the intersecting portions of the first and second edges remain in overlapping engagement in a common plane along breakpoints formed during thermal expansion or contraction of the heat exchanger; and wherein at least one point connection is located between the bases of the first and second body pieces and at least one point connection is located between the legs of the first and second body pieces.

7. The side plate of claim 6 wherein each of the point connections is defined by intersecting portions of the first and second edges that form two opposing vertices aligned with the longitudinal axis of the side plate.

8. The side plate of claim 6 wherein the first edge, second edge and the point connections define three openings.

* * * * *

UNITED STATES PATENT AND TRADEMARK OFFICE

CERTIFICATE OF CORRECTION

PATENT NO. : 7,621,317 B2
APPLICATION NO. : 11/432137
DATED : November 24, 2009
INVENTOR(S) : Rousseau et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 223 days.

Signed and Sealed this

Twenty-sixth Day of October, 2010

David J. Kappos

David J. Kappos
*Director of the United States Patent and Trademark Office*